United States Patent [19]

Dittrich et al.

[11] 4,084,419

[45] Apr. 18, 1978

[54] METHOD FOR MANUFACTURING ANNULAR METAL WORKPIECES

[75] Inventors: Erich Dittrich; Siegfried Grone, both of Dortmund, Germany

[73] Assignee: Thyssen Industrie AG, Germany

[21] Appl. No.: 775,199

[22] Filed: Mar. 7, 1977

[30] Foreign Application Priority Data

Mar. 19, 1976 Germany ..... 2611568

[51] Int. Cl.[2] ..... B21H 1/06

[52] U.S. Cl. ..... 72/68; 72/84; 72/86

[58] Field of Search ..... 72/68, 84, 86, 87

[56] References Cited

U.S. PATENT DOCUMENTS

| | | | |
|---|---|---|---|
| 965,036 | 7/1910 | Slick | 72/84 |
| 1,745,514 | 2/1930 | Taylor | 72/87 |
| 1,965,446 | 7/1934 | Bell | 72/68 |
| 2,058,007 | 10/1936 | Edelmeier | 72/68 |
| 3,611,771 | 10/1971 | Ulrych | 72/86 |
| 3,738,139 | 6/1973 | Stuart et al. | 72/86 |

OTHER PUBLICATIONS

Metals Handbook, 8th Ed., vol. 5, American Society for Metals, pp. 106 & 107, "Ring Rolling."

*Primary Examiner*—Lowell A. Larson
*Attorney, Agent, or Firm*—McGlew and Tuttle

[57] ABSTRACT

A method of manufacturing annular metal workpieces which have a deeply profiled cross-section, such as a blank flange, comprises heating the workpiece bloom or bar to a forging temperature and upsetting and piercing the workpiece to form a pierced blank. The pierced blank is then roughened by applying a force which acts at least on the outside and the inside periphery while the blank is rotated in order to form the blank into a ring which has a substantially rectangular cross-section and an inside diameter which is equal to or slightly larger than the inside diameter of the finished part. Thereupon, the ring is rotated and is shaped to the desired profile by directing a force on the front face of the rotating ring and finish-rolling it to the final internal and external diameters. The forces are exerted simultaneously on the peripheral surfaces and the front surfaces of the rotating ring. The material flow of the rotating ring is limited in the radial direction during this process. The rolling mill for carrying out the method includes first and second mill rolls which are mounted on respective axes for rotation with the axis of one of the rolls being inclined relative to the other by a small angle and with the rolls being movable toward and away from each other and with one of the rolls being formed with a negative of the face portion of the profile to be rolled, and the other formed with the negative of the other face portion of the profile being rolled which is designed on an obtuse-angled cone portion of the roll.

4 Claims, 6 Drawing Figures

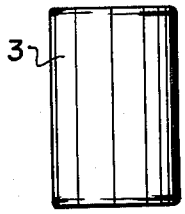
FIG. 1
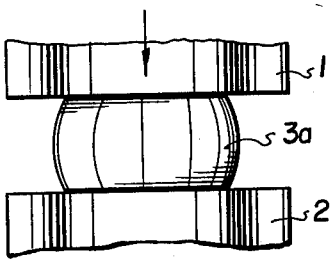
FIG. 2
FIG. 3
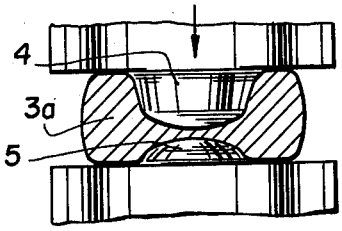
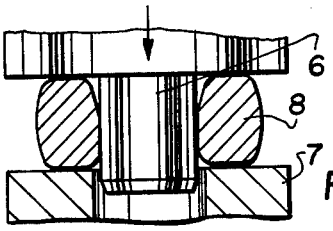
FIG. 4
FIG. 5
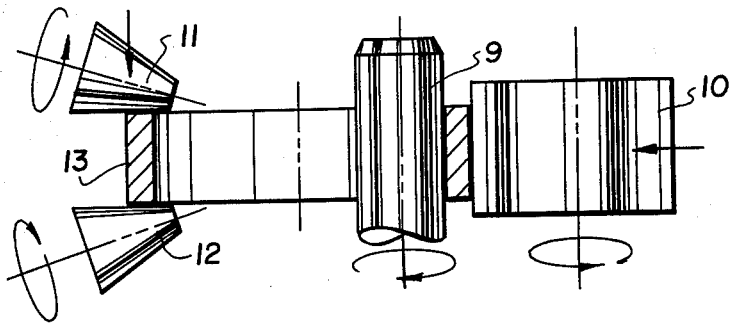
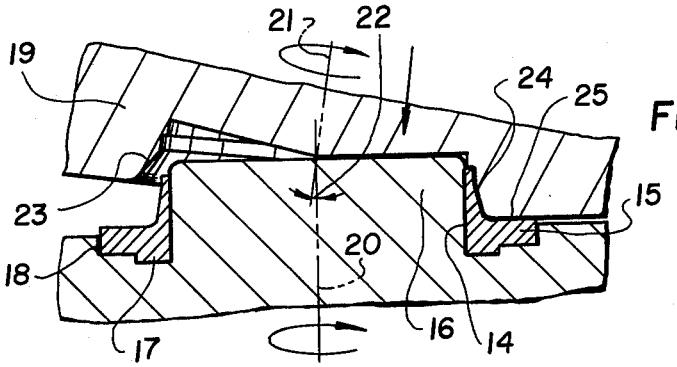
FIG. 6

METHOD FOR MANUFACTURING ANNULAR METAL WORKPIECES

FIELD AND BACKGROUND OF THE INVENTION

This invention relates in general to metal working and, in particular, to a new and useful method of manufacturing annular workpieces having a deeply profiled cross-section, such as blank flanges or the like, and to a rolling mill construction for forming annular workpieces.

DESCRIPTION OF THE PRIOR ART

Annular workpieces having a deeply profiled cross-section, such as blank flanges or the like, may be manufactured so that pieces cut from a bloom or bar which have been heated to forging temperature are formed on drop forging presses or hammers and, thereupon, pierced and deburred and, if necessary, calibrated. This manufacturing process requires considerable forming forces and involves the production of correspondingly expensive machines which are required. Further disadvantages are the high costs of tools and the great amount of waste material from piercing and deburring.

Manufacture of workpieces by machining annular blanks which have been bent and butt-welded from bar lengths, or burned out of thick plates, or rolled on mills for annular shapes are also known. However, because of the high costs and the long machining operations which are required, and the great loss of material in cuttings, such metal pieces are expensive.

It is further known to manufacture blank flanges or similar workpieces by ring rolling. For this purpose, pieces cut from blooms or bars and heated to forging temperature are upset, preformed, and pierced on a press or hammer, then roughed on a rolling mill for annular shapes, between a mandrel roll and a profiled disc roll while enlarging the diameter and approaching the final shape and, thereupon, finish-rolled in another roll groove of the disc roll or on a separate finishing mill operating similarly. To improve the shape and accuracy to size, as well as the surface quality, a ring guage may be used for the finish-rolling. With this method, a relatively small forming pressure is necessary for manufacturing the blank, and the loss of material due to piercing is relatively negligible. A disadvantage is that satisfactory workpieces can be obtained only with a very careful optimization of the preliminary shaping of the blank and of the roughed ring, which ordinarily requires time-consuming and costly series of experiments. In addition, the profiled pressing and roughing tools are expensive, are rapidly worn down due to the material friction in the tool profile, and increase the drive power required.

SUMMARY OF THE INVENTION

On the contrary, the inventive method makes it possible to manufacture blank flanges or similar workpieces with low machine and tool expenses, negligible material losses and small drive power, and it ensures a very good accuracy in in shape and size, as well as surface quality of the workpieces. The invention is based on the finding that the objective can be achieved by using planar upsetting faces for preparing the blank, smooth rolling tools for the roughing, and by a finish-rolling with almost no slip and wear, in spite of the profiled tools.

In accordance with the invention, a method is provided which comprises the operational steps of upsetting and piercing a piece cut from a bloom or bar and heated up to a forging temperature, then roughing the piece by a force acting at least on the outside and inside circumferences of the rotating blank to a ring having a substantially rectangular cross-section and an outside diameter which is equal to or slightly larger than the inside diameter of the finished workpiece and, finally, finish-rolling it to profile and to the final diameters by a force acting on the front faces of the rotating ring. In order to be able to easily adapt the cross-section of the roughed ring to the actual requirements, the invention further provides that during the roughing operation, forces are exerted simultaneously on the peripheral surfaces and the front surfaces of the rotating blank. To ensure a good accuracy to size of the important surfaces of the workpiece and thereby minimizing the costs of further working, the material flow of the rotating ring is limited in the radial direction during the finish-rolling operation. Finally, to obtain the advantages of the inventive method with a minimum of expenses, the finish-rolling is done by means of a rolling mill having two rolls which can be moved axially toward each other and of which at least one is driven and one has its front surface shaped as a negative of one portion of the profile to be rolled while the other roll, the axis of which is inclined relative to the axis of the first roll by a small angle, has the shape of a negative of the other portion of the profile to be rolled which negative is provided on the superficies of an obtuse-angled cone. Such rolling mills which are employed for rolling disc-shaped workpieces, for example, solid railroad wheels or the like, out of preshaped blanks, are known per se (for example, from U.S. Pat. No. 965,039) but have not been used as yet for folling annular workpieces having a deeply profiled cross-section, in accordance with the inventive method.

Accordingly, it is an object of the invention to provide a method of manufacturing an annular metal part which has a deeply profiled cross-section which comprises heating the workpiece bloom to a forging temperature and upsetting and piercing the workpiece to form a pierced blank, roughing and pierced blank by applying a force acting at least on the outside and the inside periphery while the blank is rotated in order to form the blank into a ring which has a substantially rectangular cross-section and an inside diameter which is equal to or slightly larger than the inside diameter of the finished part to be formed and, thereupon, rotating the ring and shaping it to the desired profile by directing a force on the front face of the rotating ring and finish-rolling the ring to the final internal and external diameters.

A further object of the invention is to provide a rolling mill for rolling respective opposite face portions of a pierced workpiece, which comprises first and second mill rolls which are mounted for rotation about separate first and second respective axes and which are also movable toward and away from each other in respective axial directions and, wherein, at least one of the rolls is driven and the first roll has a front surface shaped as a negative of one face portion of the profile to be rolled and the second roll is shaped with the negative of the profile of the other surface to be rolled and wherein the rolls are arranged so that their axes are inclined relatively by a small angle.

A further object of the invention is to provide an apparatus for manufacturing annular metal workpieces which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawings and descriptive matter in which there is illustrated a preferred embodiment of the invention.

BRIEF DESCRIPTION OF THE DRAWINGS

In the Drawings:

FIG. 1 is a side elevational view of a bloom or bar workpiece;

FIG. 2 is a side elevational view indicating the workpiece being upset;

FIG. 3 is a view similar to FIG. 2 indicating the workpiece being pierced;

FIG. 4 is a view similar to FIG. 3 showing the final piercing of the workpiece;

FIG. 5 is a view showing the roughing of the ring which is formed from the pierced workpiece; and FIG. 6 is a sectional view showing the apparatus for the finish-rolling of the workpiece ring.

DESCRIPTION OF THE PREFERRED EMBODIMENT

Referring to the drawings in particular, the method of the forming of an annular metal part having a deeply profiled cross-section is set forth in respect to the method steps indicated in FIGS. 1 through 6.

A workpiece 3, cut from a bloom or bar and heated to a forging temperature, is disposed between flat upsetting faces 1 and 2 of a press or hammer, and is upset (FIG. 2). The upset workpiece 3*a* is then prepierced with prepiercing tools 4 and 5 (FIG. 3) and pierced through with finish-piercing tools 6 and 7 (FIG. 4). The hole of the pierced blank 8 has a slightly larger diameter than the mandrel roll 9 of the roughing mill for annular shapes (FIG. 5).

The roughing mill for annular shapes comprises a driven disc roll 10 acting on the outer periphery of the blank, a mandrel roll 9 acting on the inside diameter of the blank, and two frustoconical axial rolls 11 and 12 acting on the front sides of the blank. At least one of the axial rolls 11 and 12 is driven and they are movable relatively toward and away from each other.

At the end of the roughing operation, the roughed ring 13 takes a rectangular cross-sectional shape and has a slightly smaller height relative to the pierced blank 8 and has an inside diameter which is slightly larger than the inside diameter 14 of the finished flange 15, shown in FIG. 6.

The finishing mill comprises a driven lower roll 16 having the shape of a negative of the lower front face 17, the inside diameter 14, and the outside diameter 18 of the flange. The upper roll 19 is also driven and movable toward lower roll 16 in the direction of the axis of rotation 20 of the lower roll. The axis of rotation 21 of upper roll 19 is slightly inclined relative to axis of rotation 20, by an angle 22 of, ordinarily, about from 2° to 20°, depending on the diameter of the flange. The underside and inside surfaces 23 of upper roll 19 form a truncated cone on which a negative of the remaining surfaces 24 and 25 of the flange to be rolled is provided in a manner such that the narrowest roll gap between lower roll 16 and upper roll 19 corresponds to the cross-section of the finished flange 15.

During the finish-rolling operation, while in-feeding upper roll 19, material is displaced from the zone of the upper outside diameter of the roughed blank 13 and forced into the zone of the large outside diameter of the finished flange 15, whereby, at the same time, the inside diameter gets its final dimension. The arrows added in the drawing and having no reference numerals indicate the directions of motion or acting forces.

While a specific embodiment of the invention has been shown and described in detail to illustrate the application of the principles of the invention, it will be understood that the invention may be embodied otherwise without departing from such principles.

What is claimed is:

1. A method of manufacturing annular metal parts having a deeply profiled cross-section, such as blank flanges, comprising heating a workpiece bloom to a forging temperature, upsetting and piercing the workpiece to form a pierced blank, roughing the pierced blank by applying a force acting at least on the outside and inside periphery of the blank while the blank is being rotated in order to form the blank into a ring having a substantially rectangular cross-section and an inside diameter which is equal to or slightly larger than the inside diameter of the finished part and, thereupon, rotating the ring and shaping it to the desired profile by directing a force on the front faces of the rotating ring and finish-rolling the ring to the final internal and external diameters of the part.

2. A method of manufacturing annular metal parts having a deeply profiled cross-section, according to claim 1, wherein during the roughing operation, forces are exerted simultaneously on the peripheral surfaces and the front surfaces of the rotating blank.

3. A method of manufacturing annular metal parts having a deeply profiled cross-section, according to claim 1, wherein during the finish-rolling operation, the material flow from the ring as it is being rotated is limited in the radial direction.

4. A method of manufacturing annular workpieces having a deeply profiled cross section such as blank flanges, comprising heating a bloom or bar blank to a forging temperature, upsetting and piercing the heated blank, subsequently rough forming the upset and pierced blank in a first ring rolling process by rotating it and applying a force acting at least on the outside and inside of the rotating blank to form a ring having a substantially rectangular cross section with an inside diameter which is equal to and slightly larger than that of the finished workpiece and an outside diameter which is substantially smaller than the maximum diameter of the finished workpiece, and finally finish rolling the rough formed blank in another ring rolling process by applying a force acting on the front face of the rotating workpiece to shape the workpiece to profile and to finish roll it to the final diameter, with the inside diameter being subject to substantially no change.

* * * * *